US008899703B2

(12) United States Patent
Chung

(10) Patent No.: US 8,899,703 B2
(45) Date of Patent: Dec. 2, 2014

(54) PRESSING-TYPE UNLOCKING TRACK

(71) Applicant: Nan Juen International Co., Ltd., New Taipei (TW)

(72) Inventor: Jung-Chang Chung, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 0 days.

(21) Appl. No.: 13/875,793

(22) Filed: May 2, 2013

(65) Prior Publication Data

US 2014/0327351 A1 Nov. 6, 2014

(51) Int. Cl.
*A47B 95/02* (2006.01)
*A47B 88/04* (2006.01)

(52) U.S. Cl.
CPC ..... *A47B 88/0477* (2013.01)
USPC ..... 312/333; 312/334.8

(58) Field of Classification Search
CPC .. A47B 88/04; A47B 88/047; A47B 88/0477; A47B 88/0481; A47B 2210/0091
USPC ..... 312/333, 334.1, 334.2, 334.7, 334.8
See application file for complete search history.

(56) References Cited

U.S. PATENT DOCUMENTS

| | | | | |
|---|---|---|---|---|
| 7,210,198 | B2 * | 5/2007 | Hoshide et al. | 16/96 R |
| 7,481,505 | B2 * | 1/2009 | Orita | 312/333 |
| 8,393,693 | B2 * | 3/2013 | Juan et al. | 312/333 |
| 8,496,306 | B2 * | 7/2013 | Chen et al. | 312/333 |
| 8,714,671 | B2 * | 5/2014 | Huang | 312/333 |
| 2009/0115300 | A1 * | 5/2009 | Chen et al. | 312/334.1 |
| 2011/0175508 | A1 * | 7/2011 | Rechberg et al. | 312/334.8 |
| 2012/0301062 | A1 | 11/2012 | Huang | |
| 2013/0104339 | A1 * | 5/2013 | Shimizu | 16/72 |

* cited by examiner

*Primary Examiner* — Daniel Rohrhoff
(74) *Attorney, Agent, or Firm* — Muncy, Geissler, Olds & Lowe, P.C.

(57) ABSTRACT

A pressing-type unlocking track comprising: a track component with a main slide channel at its up lateral side on which an arresting return passage and a lateral return passage are arranged next to its front end; a driving component with a guide column held in the main slide channel; a linkage component backward pivoted to the driving component and comprising a track rib situated at its one side and held in the main slide channel; a positioning component backward pivoted to the linkage component and comprising a protruded guide column situated at its one side and held in the main slide channel; a spring connected between the track component and the linkage component as one component applying pulling force on the linkage component. As such, three main components such as driving component, linkage component and positioning component can be pivoted to a triple subassembly.

14 Claims, 5 Drawing Sheets

PRESSING-TYPE UNLOCKING TRACK

BACKGROUND OF THE INVENTION

1. Field of the Invention

The present invention relates to a track, particularly a pressing-type unlocking mechanism applied in a track or a pressing-type unlocking track by which a drawer in a cabinet can be opened conveniently and smoothly.

2. Description of the Related Art

Cabinets with pull-out drawers installed have been extensively applied in all kinds of storage equipment wherein each of the drawers to be conveniently opened by users is usually integrated with tracks at its both lateral sides for positioning and guiding the drawer. In order to open a drawer easily, the tracks are provided with pressing-type unlocking mechanisms by which a drawer is slightly opened outward under effect of pressure and further dragged out completely. The pressing-type unlocking track based on the prior art is shown in R.O.C. Patent Number M384581 which discloses a pressing-type automated unlocking device comprising a track body, a positioning device and a limit stop: the track body is provided with a joining bar and a joining part at its lateral end, both of which develop an assembling part at their same sides; the positioning device coordinates the joining part on the track body and consists of a positioning component and a passive component, both of which additionally link an elastic component in between: (a) the positioning component has two long sides on which limit flanges extend and one end plane on which a shifting groove is properly opened and a holding block is installed and (b) the passive component extends along one side on which there is an embedding chute and has a restoration groove located at the bottom side and tapering inward; the limit stop is assembled onto the assembling part at one side of the joining bar and laterally provided with a resisting bump arranged from the rear end to the center: (a) the resisting bump develops a serrate center on which there are a shifting notch as well as a shifting contact end and further comprises a raised positioning bump at its front on which there is a triangular concave positioning notch facing an end plane of the resisting bump and allowing its inner vertex angle not to align a parallel line at the center of the resisting bump and (b) the positioning bump has one side tilt toward the shifting notch on the resisting bump for development of a shifting slope. As such, the joining part at one side of the track body is prepared for installation of the positioning device whose passive component based on its restoration groove facing inward and embedding chute at the bottom is held on the limit flanges at both sides of the positioning component and connected to the positioning component by means of the elastic component wherein the positioning component of the positioning device is inward assembled onto the joining part of the track body and the passive component is situated at an opening of the track body. Finally, the limit stop has the resisting bump which is inward assembled onto the assembling part of the joining bar to become a pressing-type automated unlocking track.

The pressing-type unlocking track based on the prior art which is effective in driving a drawer to slide forward still has some drawbacks as follows. For examples, a relative distance between the passive component and the positioning component on which the passive component slides is limited because of these two components' small volume; the elastic component linking lateral sides of both the passive component and the positioning component must be also a tiny component which completes limited movement, restraining elasticity induced by pressure applied on a drawer, and failing in preferred movement effect when a drawer, particularly a drawer in which more objects are loaded, is pressed. On the other hand, the pressing-type unlocking track based on the prior art is an unideal design because a drawer on which a pressing force is difficultly applied causes the small elastic component sustaining higher weight to be elastically fatigued/damaged or even fail. Moreover, the conventional pressing-type unlocking track running by transient collision between the limit stop and the passive component and relative slide between the passive component and the positioning component features small-size components separated from each other and easily disengaged or out of order due to application of large inertial force or pressing force in the course of relative movement and even deteriorating a drawer's operation or closing. Therefore, the abovementioned drawbacks in a conventional pressing-type unlocking track deserve to be overcome by persons skilled in the art.

Accordingly, the inventor having considered imperfect structural design and drawbacks of the prior art and attempted to optimize a solution, that is, a pressing-type unlocking track moving stably, smoothly and accurately, has studied and developed the present invention for benefiting the general public and promoting development of the industry.

SUMMARY OF THE INVENTION

The object of the present invention is to provide a pressing-type unlocking track by which a drawer in the course of a press-and-open operation first slides outward by an elastic force and facilitates a user's drag latter.

The other object of the present invention is to provide a pressing-type unlocking track in which all main components are interlinked, strengthen stable movement, and ensure smooth operation, accuracy and life cycle.

The further object of the present invention is to provide a pressing-type unlocking track designed to be a superior elastic structure which is in favor of slide movement and minimized elastic fatigue and aggressively promotes practicability, smooth operation and competitiveness of one product.

The present invention is based on following technical measures to realize the above purposes: a track device, which comprises a track component, and said track component further comprises: (a) a main slide channel at up lateral side of the track component, (b) a stop-end wall at the main slide channel's front end, (c) a stop block situated at the rear position of the stop-end wall, (d) a concave arresting part at the front end of the stop block, (e) an arresting return passage developed between the stop block and the stop-end wall and connected to the main slide channel, (f) a lateral return passage which is located next to the stop block and at one lateral side opposite to that of the main slide channel, and further links the main slide channel and the arresting return passage, and (g) a spring slot on the track component and at one lateral side opposite to the main slide channel; a driving component which comprises (a) a guide column located at its one side and held in the main slide channel, (b) a guide shoe on its top portion, and (c) a driving plane at the rear end of the guide shoe; a linkage component backward pivoted to the driving component and comprising a track rib situated at one side and held in the main slide channel; a positioning component which is backward pivoted to the linkage component and comprises a protruded guide column situated at its front end and held in the main slide channel; a spring held in the spring slot on the track component and connected between the track component and the linkage component as one component applying elasticity on the linkage component.

For technical features and effects in terms of the present disclosure completely comprehended and recognized, the preferred embodiments and accompanying drawings are thoroughly described hereinafter.

DETAILED DESCRIPTION OF THE PREFERRED EMBODIMENTS

Figure 1:
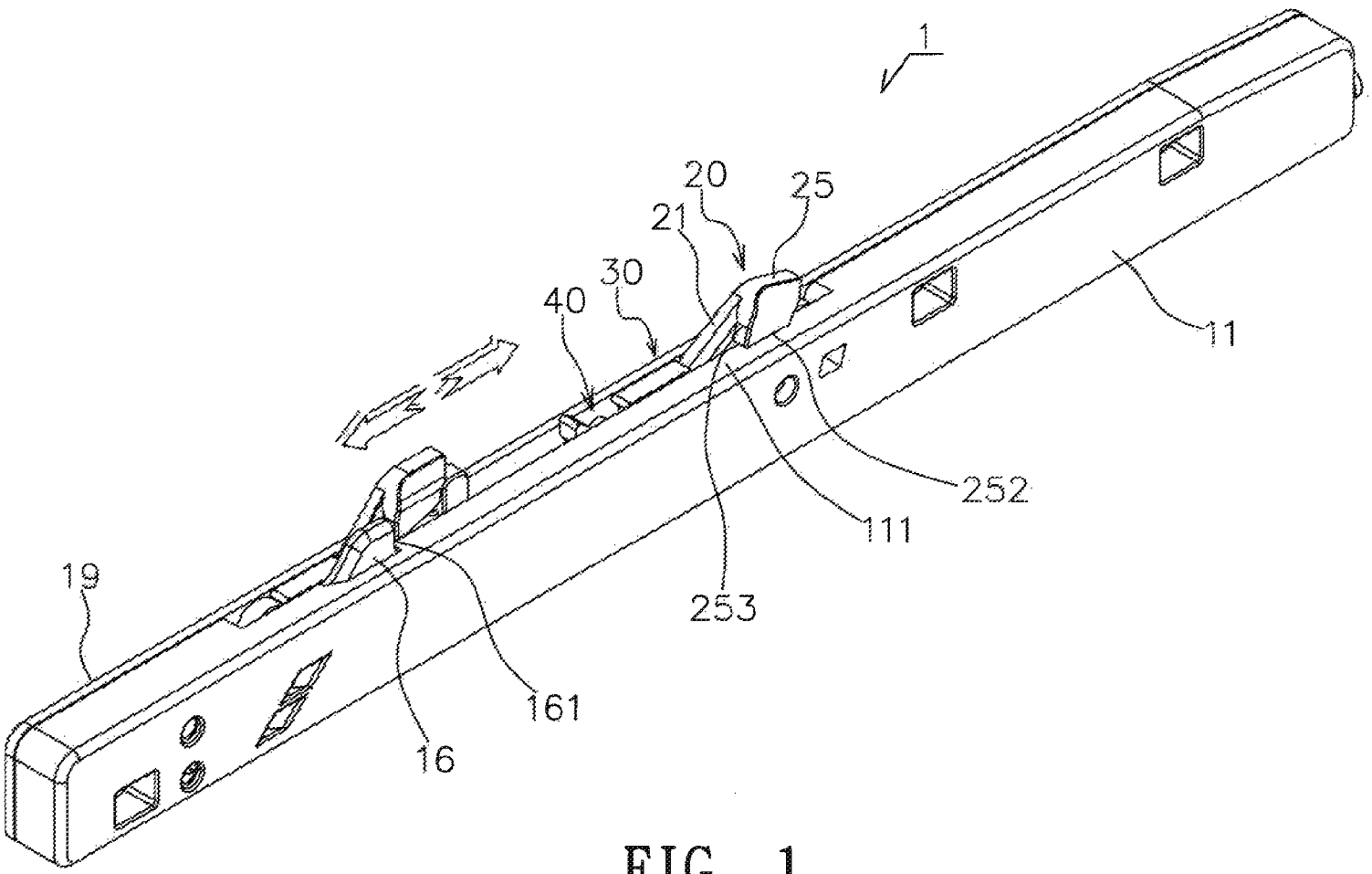
FIG. 1 is a schematic perspective view of the present invention which is assembled.
Figure 2:
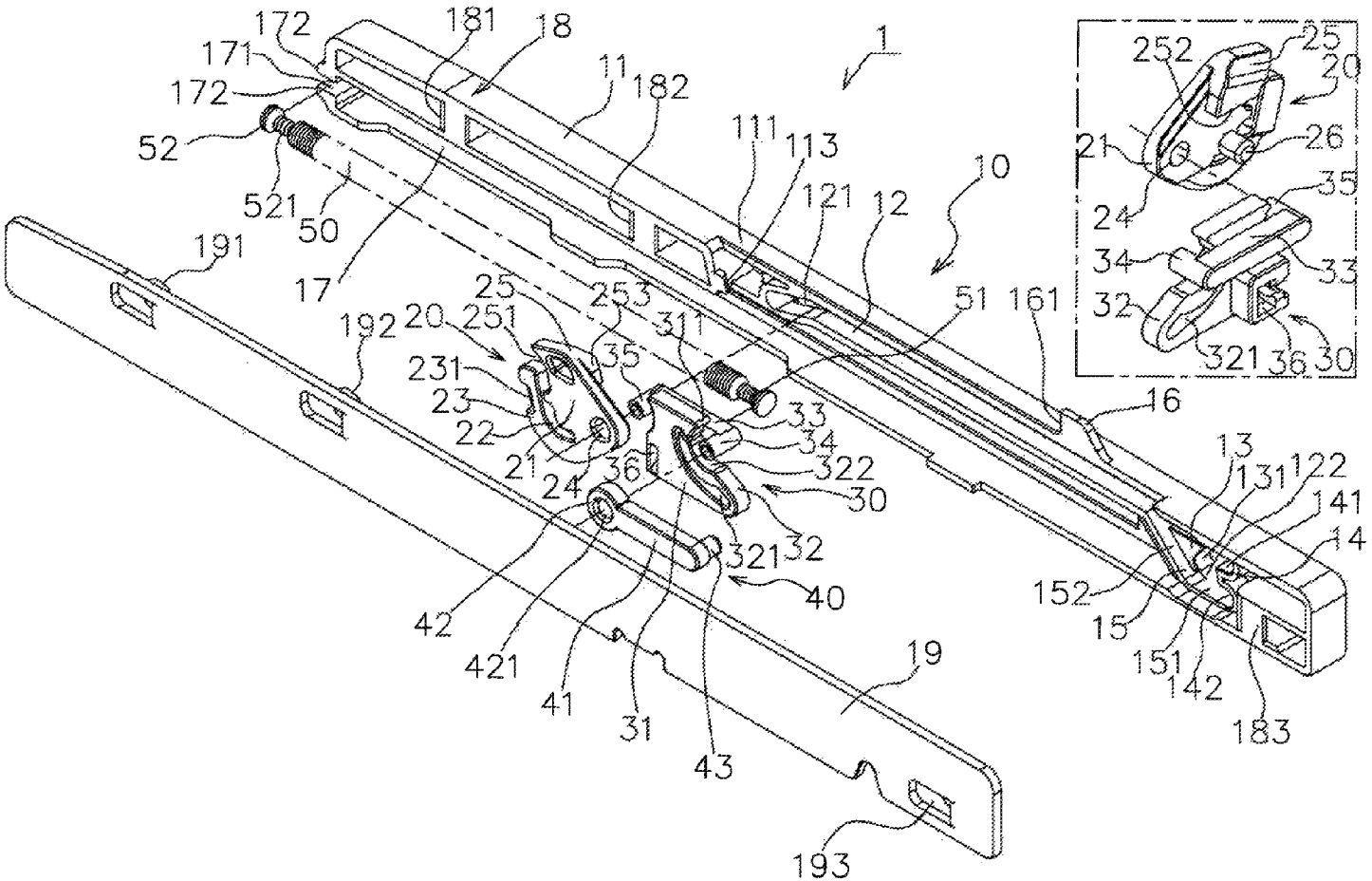
FIG. 2 is a schematic exploded view of the present invention which is disassembled.

Referring to FIGS. 1 and 2 which illustrates the present invention of a pressing-type unlocking track comprises a pressing-type track assembly 1 that further comprises a track device 10, a driving component 20, a linkage component 30, and a positioning component 40. The track device 10 comprises a track component 11 and a track cap 19: the track component 11 has a main slide channel 12 at one lateral side and a slide track wall 111 outside the main slide channel 12 so that a rear chute 121 tilting inward and a stop-end wall 14 as two no-go ends are designed in the rear end and front end of the main slide channel 12, respectively. The stop-end wall 14 develops a curved first stop way 141, which abuts, links, and is tilted toward the main slide channel 12, as well as a curved second stop way 142 at its up and down positions, respectively. A stop block 13 disposed at rear position of the stop-end wall and abuts the internal front end of the main slide channel 12 and comprises a concave arresting part 131 ahead for development of an arresting return passage 122 located between the stop block 13 and the stop-end wall 14 and connected to the main slide channel 12 and a lateral return passage 15 which is disposed below the stop block and is situated at one side opposite to the main slide channel 12; and the lateral return passage 15 further comprises a first lateral return passage 151 transversely arranged and a second lateral return passage 152 obliquely connected to the main slide channel 12 for development of a heart-shaped loop among the front end of the main slide channel 12, the arresting return passage 122 and the lateral return passage 15: the first stop way 141 links and precedes both the main slide channel 12 and the arresting return passage 122; the second stop way 142 links and precedes the arresting return passage 122 and the lateral return passage 15 (first lateral return passage 151). Moreover, the track component 11 comprises (a) a resisting convex part 16 which is situated at the front end of the slide track wall 111 and has a resisting plane 161 at its rear end, (b) a spring slot 17, which is situated at one side opposite to the main slide channel 12 and rearward connected to a straight narrow channel 171 along with a stopper 172 behind, (c) an abutment part 113 next to the rear end of the rear chute 121 (main slide channel 12), and (d) a clamping device 18 on which there are a plurality of clamping panels 181, 182, 183 transversely arranged. The track cap 19 mounted on the track component 11 has a plurality of bended inserts 191, 192, 193 which are correspondingly embedded into the clamping panels 181, 182, 183 at the track component 11 on which the track cap 19 can be securely covered.

The driving component 20 comprises a driving body 21 on which there are a curved resistance part 23 laterally and a separate slot 22 between the resistance part 23 and the driving body 21: the resistance part 23 allows its one end to link the driving body 21 and its other end to become a free end such as elastic member, having a rear end plane on which a resisting groove 231 is designed; the driving body 21 comprises a through pin hole 24 at its front end, and further comprises on its side facing the main slide channel 12: a guide column 26 located at its central position approximately and a guide shoe 25 located at its top position; the guide shoe 25 including (a) a driving plane 251 at its rear end, preferably a concave curved surface or an arc-shaped surface, which is opposite to a up end of the separate slot 22, (b) a guide plane 252 at down side facing the guide column, and (c) an abutment plane 253 situated at its front end and driven to contact the resisting plane 161 of the resisting convex part 16 as one safety design during press contact. The driving component 20 to be assembled allows the guide column 26 to be held in the main slide channel 12, the guide plane 252 on the guide shoe 25 to contact the slide track wall 111, and the guide shoe 25 to protrude from the track component 11.

The linkage component 30 comprises a linkage body 31 with (a) a track rib 33 located on an up position of a side of the linkage body 31 facing the main slide channel 12 and the track rib 33 further comprising protruded first join column 34 and second join column 35 facing the track cap 19 at its front end and read end, respectively and (b) a curved joining resistance part 32 situated at the front end of the linkage body 31 and recessed inward for development of a separate slot 321 between the linkage body 31 and the joining resistance part 32 whose one end links the linkage body 31 and other end becomes a free end such as an elastic member next to the rear end of the first join, column 34. Moreover, both the joining resistance part 32 and the linkage body 31 have partially a curved surface 322, 311, respectively which is next to the first join column 34 and in favor of linking the first join column 34; the linkage body 31 further comprises a clamping groove 36 at the down position opposite to the track rib 33. The linkage component 30 to be assembled makes the second join column 35 pivoted to the pin hole 24 on the driving body 21 and the track rib 33 held in the main slide channel 12. The positioning component 40 comprises a stick-like positioning body 41 which features a pivot part 42 situated at its rear end, a pin hole 421 on the pivot part 42, and a guide column 43 protruding from the front end of the positioning body 41 toward the main slide channel 12. The positioning component 40 to be assembled allows the pin hole 421 to link the first join column 34 of the linkage body 31, the pivot part 42 to be pivoted to the curved surfaces 322, 311, and the guide column 43 to be held in the main slide channel 12.

The driving component 20, the linkage component 30 and the positioning component 40 are pivoted to each other to form a triple subassembly, and by means of the guide column 26, the track rib 33 and the guide column 43, the triple subassembly is sliding as a whole in the main slide channel 12. Furthermore, a spring 50 which is installed in the spring slot 17 of the track component 11 has coupling terminals 51, 52 located at its front and rear ends, respectively: the front coupling terminal 51 is securely held in the clamping groove 36 of the linkage body 31; the rear coupling terminal 52 resists the stopper 172 at the rear end of the track component 11 and allows a telescopic part 521 at its front end to be exactly held in the straight narrow channel 171. As such, the spring 50 is positioned between and connected to the rear end of the track component 11 and the linkage component 30 on which an elastic force is applied.

Figure 5:
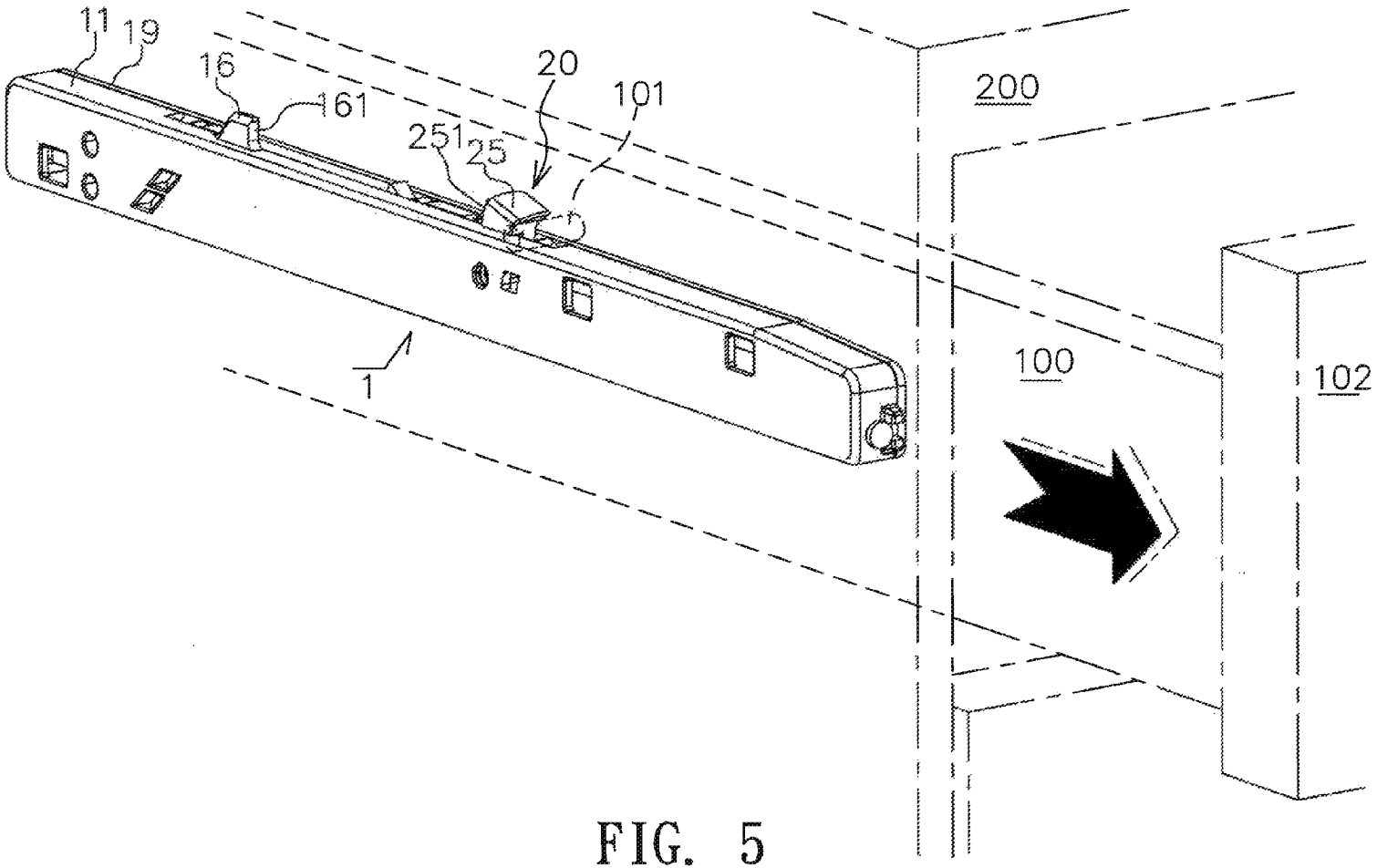
FIG. 5 is a schematic view illustrating the assembled present invention in operation.

Referring to FIG. 5 which illustrates (a) a drawer 100 held in a cabinet 200 comprises a front drawer panel 102 and a push rod 101 laterally and (b) the track device 10 (pressing-type track assembly 1) installed at lateral side of the cabinet 200 realizes a relative motion between the push rod 101 and the pressing-type track assembly 1.

Referring to FIGS. 3A to 3C and 5 which illustrate the present invention of a pressing-type unlocking track in a press-to-open operation wherein the directions of the operation are illustrated by that of the drawer 100 is pushed forward or dragged backward by an user. In the case of the drawer 100 held in the cabinet 200 (FIG. 3A), the positioning body 41 which is deflected makes the front guide column 43 engage the concave arresting part 131 of the stop block 13, the pressing-type track assembly 1 is temporarily held, and the spring 50 is stretched. For the drawer 100 to be pressed and removed from the cabinet 200, the front drawer panel 102 will sustain a small pressure by which the push rod 101 resists the driving plane 251 of the guide shoe 25 and the driving component 20 driven forward allows the guide column 43 of the positioning component 40 to be separated from the concave arresting part 131 temporarily and further to be backward dragged into the lateral return passage 15 and the main slide channel 12 (FIGS. 3B and 3C) through the arresting return passage 122 under effect of the spring 50 applying elastic force on the linkage component 30. Moreover, the triple subassembly, that is, the driving component 20, the linkage component 30 and the positioning component 40 which are dragged by elastic force, is also shifted backward: the push rod 101 on the lateral side of the drawer 100 is pushed backward by the driving plane 251 of the driving component 20 and the drawer 100 is opened from the cabinet 200 under effect of elasticity, as such the press-and-open operation to open the drawer 100 is completed.

The driving component 20 shifted backward due to elasticity makes the guide column 26 guided into the rear chute 121 from the main slide channel 12 and the rear resisting groove 231 of the resistance part 23 contact the abutment part 113 of the track component 11 with neither impact-induced vibration nor noise heard because of the separate slot 22 arranged between the driving body 21 and the resistance part 23 which features elastic buffering and promotes smooth movement of the drawer 100 to be pressed and shifted outward. The rear resisting groove 231 of the resistance part 23 which is manufactured with elastic material such as plastic and rubber is able to absorb any impact-induced force without vibration or noise and prevent any component from damage while resisting the abutment part 113. Furthermore, the resistance part 23 manufactured with elastic material and the separate slot 22, both of which are designed for movement of the triple subassembly, that is, the driving component 20, the linkage component 30 and the positioning component 40 pivoted to each other, is effective in absorbing impact and thoroughly protect these components from damage when the drawer is opened or closed.

Figures 3A, 3B, 3C:
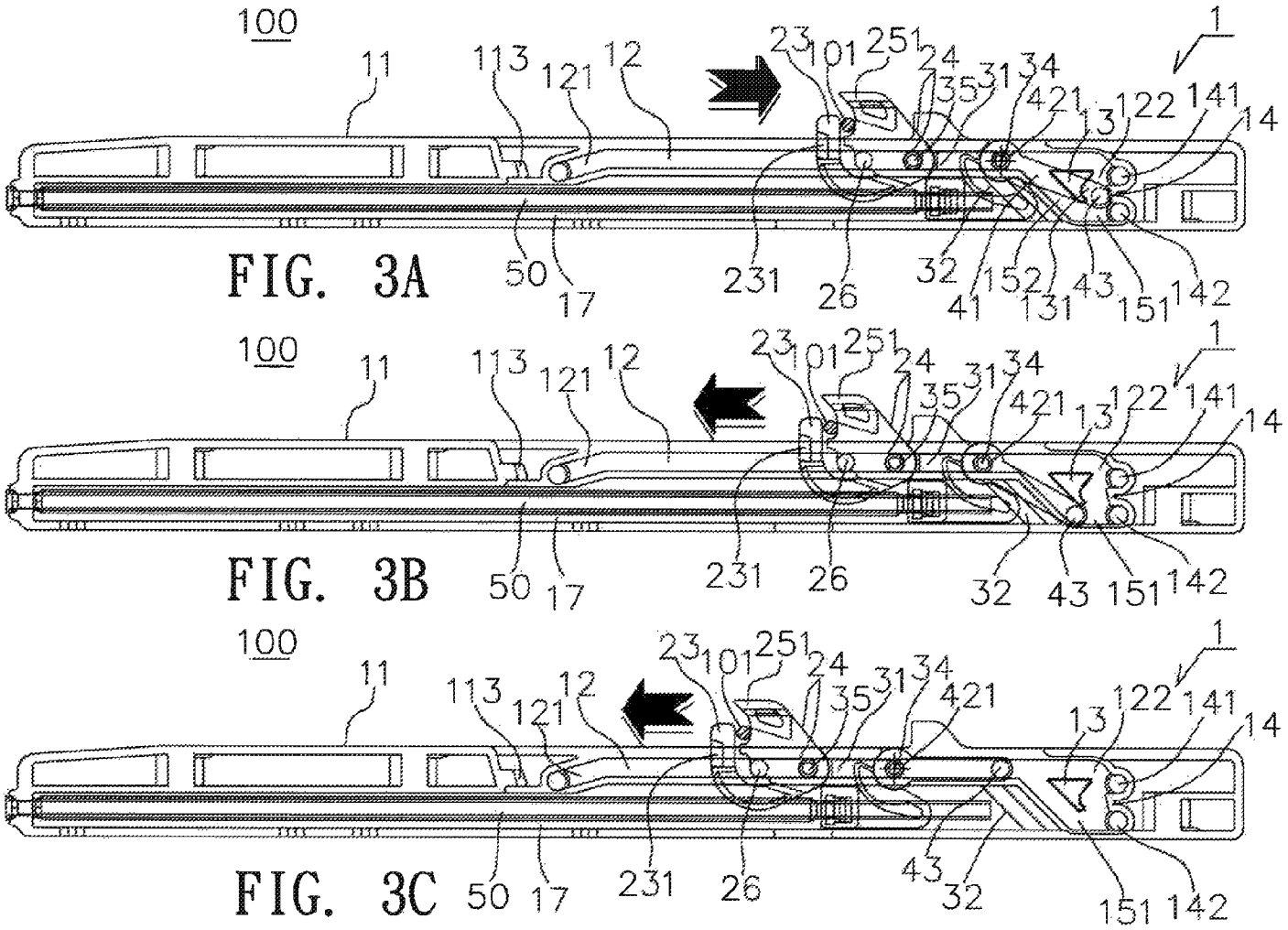
FIGS. 3A to 3C are schematic views which illustrate an operation of the present invention when a drawer is opened.
Figures 4A, 4B, 4C:
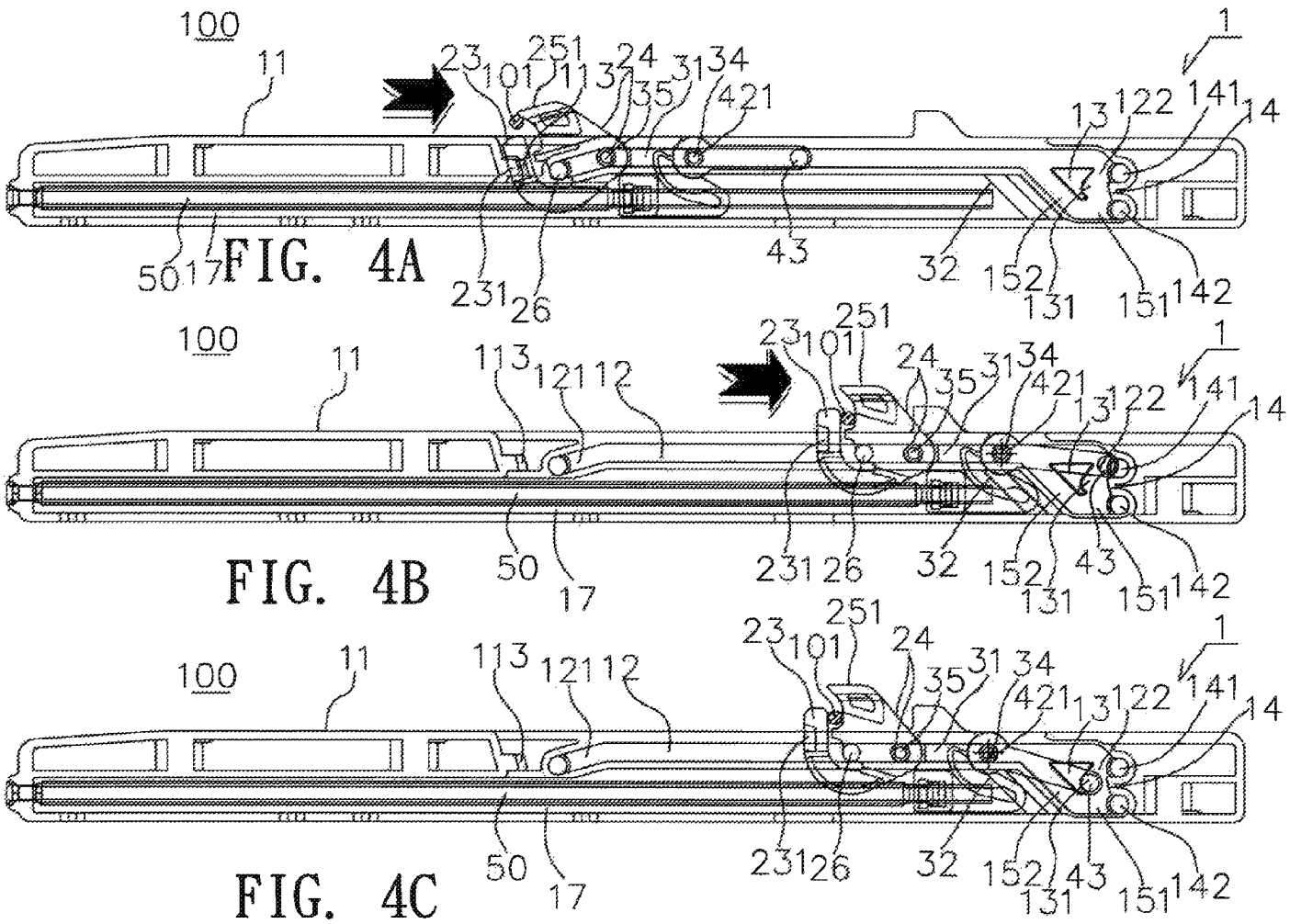
FIGS. 4A to 4C are schematic views which illustrate an operation of the present invention when a drawer is closed.

Refer to FIGS. 4A to 4C and 5 which illustrate the present invention of a pressing-type unlocking track in a push-to-close operation. As shown in FIG. 4A, the push rod 101 on the opened drawer 100 to be pushed and closed is driven forward, resisting the driving plane 251 on the driving component 20, and forward pushing the driving component 20 which makes the guide column 26 shift to the main slide channel 12 from the rear chute 121 and continue moving forward, and the spring 50 gradually stretched. Next, the front guide column 43 of the positioning body 41 is first guided to the first stop way 141 through the main slide channel 12 and then dragged backward into the arresting return passage 122 under effect of elasticity and held by the concave arresting part 131 for closing the drawer 100 (FIG. 4C) and resuming original status of the drawer 100 which is held in the cabinet (FIG. 3A).

The present invention of a pressing-type unlocking track based on design hereinbefore for its operation features a subassembly consisting of three main components such as driving component, linkage component and positioning component which are pivoted to each other and has advantages as follows: superior structural strength, better stability in the course of movement, smooth operation, accuracy, and longer life cycle. Moreover, the present invention designed to be a superior elastic structure provides sufficient elastic force which is in favor of slide movement and minimized elastic fatigue and aggressively promotes practicability, smooth operation and competitiveness of one product.

It can be seen that the present invention of a pressing-type unlocking track based on interlinked devices creates effective synchronous triple tracks and superior smoothness and accuracy in the course of track movement, conforming to economic efficiency and better track design, and actively promoting practicability, texture perception and competitiveness of one product.

Therefore, the present invention significantly meets patentability and is applied for the patent. However, the above descriptions are only preferred embodiments which do not limit the scope of the present invention; any equivalent change or improvement without departing from spirit of the present invention should be incorporated in claims herein.

What is claimed is:

1. A pressing-type unlocking track, comprising:

a track device which comprises a track component; and said track component further comprises: (a) a main slide channel at a lateral side of said track component, (b) a stop-end wall at said main slide channel's front end, (c) a stop block situated at said stop-end wall's rear position and next to said main slide channel's inner front, (d) a concave arresting part at said stop block's front end, (e) an arresting return passage developed between said stop block and said stop-end wall and connected to said main slide channel, (f) a lateral return passage which is located under said stop block and at one side opposite to said main slide channel and links said main slide channel and said arresting return passage, and (g) a spring slot on said track component and at one lateral side opposite to said main slide channel;

a driving component which comprises (a) a guide column located at its one side and held in said main slide channel, (b) a guide shoe at its top position, and (c) a driving plane at said guide shoe's rear end;

a linkage component backward pivoted to said driving component and comprising a track rib situated at its up position and held in said main slide channel; and a positioning component which is backward pivoted to said linkage component and comprises a protruded guide column situated at its front end and held in said main slide channel;

a spring held in said spring slot on said track component and connected between said track component and said linkage component as one component applying elasticity on said linkage component.

2. A pressing-type unlocking track according to claim 1 wherein said track component has a slide track wall outside said main slide channel and said main slide channel has a rear chute tilting inward as a no-go side.

3. A pressing-type unlocking track according to claim 2 wherein said stop-end wall develops a curved first stop way, which abuts, links, and is tilted toward said main slide channel, as well as a curved second stop way at up and down positions of said stop-end wall, respectively.

4. A pressing-type unlocking track according to claim 3 wherein said lateral return passage comprises a first lateral return passage transversely arranged and a second lateral return passage obliquely connected to said main slide channel for development of a loop among said main slide channel's front end, said arresting return passage and said lateral return passage.

5. A pressing-type unlocking track according to claim 2 wherein said track component has a resisting convex part at said slide track wall's front end and said resisting convex part has a resisting plane at its rear end.

6. A pressing-type unlocking track according to claim 1 further comprises a track cap which is mounted on said track component with a plurality of clamping panels transversely arranged and has a plurality of bended inserts correspondingly embedded into said clamping panels at said track component.

7. A pressing-type unlocking track according to claim 1 wherein said driving component comprises a driving body on which there is a resistance part laterally disposed; and a separate slot disposed between said resistance part and said driving body so that said resistance part allows its one end to link said driving body as well as its other end to be a free end; and a resisting groove is designed on a rear end plane of said resistance part.

8. A pressing-type unlocking track according to claim 7 wherein said resistance part is manufactured with elastic material.

9. A pressing-type unlocking track according to claim 7 wherein said driving body comprises a through pin hole at its front end, said driving plane is a concave curved surface or an arc-shaped surface, and said guide shoe comprises a guide plane inside abutting said slide track wall and protruding said guide shoe from said track component.

10. A pressing-type unlocking track according to claim 1 wherein said linkage component comprises a linkage body, and a first join column and a second join column protruded from said track rib's front end and rear end, respectively; and a joining resistance part situated at said linkage body's front end and recessing inward, and a separate slot developed between said joining resistance part and said linkage body so that said joining resistance part has its one end linking said linkage body and other end as a free end.

11. A pressing-type unlocking track according to claim 10 wherein said free end of said joining resistance part is located next to rear end of said first join column, both said joining resistance part and said linkage body develop curved surfaces next to said first join column; and said linkage body has a clamping groove situated at its down position opposite to said track rib for fixing said spring.

12. A pressing-type unlocking track according to claim 1 wherein said positioning component comprises an elongated positioning body with a pin hole at its rear end.

13. A pressing-type unlocking track according to claim 1 wherein said spring has one end held in a stopper at said track component's rear end.

14. A pressing-type unlocking track according to claim 1 wherein said track device is laterally installed at a cabinet in which a drawer is held and said drawer is laterally provided with a push rod so that a relative movement is made on said push rod and said driving plane of said driving component.

* * * * *